US012203460B2

(12) United States Patent
Simmons et al.

(10) Patent No.: US 12,203,460 B2
(45) Date of Patent: Jan. 21, 2025

(54) POWER SYSTEM

(71) Applicant: FOREFRONT ENERGY LTD., Dawson Creek (CA)

(72) Inventors: Daniel Simmons, Dawson Creek (CA); Nathan Simmons, Dawson Creek (CA); Jordan Simmons, Dawson Creek (CA)

(73) Assignee: FOREFRONT ENERGY LTD., Dawson Creek (CA)

( * ) Notice: Subject to any disclaimer, the term of this patent is extended or adjusted under 35 U.S.C. 154(b) by 0 days.

(21) Appl. No.: 18/496,412

(22) Filed: Oct. 27, 2023

(65) Prior Publication Data

US 2024/0141882 A1 May 2, 2024

(30) Foreign Application Priority Data

Oct. 28, 2022 (CA) ..... CA 3180778

(51) Int. Cl.
*F04B 23/06* (2006.01)
*F04B 1/02* (2006.01)

(52) U.S. Cl.
CPC ..... *F04B 23/06* (2013.01); *F04B 1/02* (2013.01); *F04B 2205/01* (2013.01); *F04B 2205/05* (2013.01); *F04B 2205/07* (2013.01)

(58) Field of Classification Search
CPC .... F04B 2205/05; F04B 2205/01; F04B 1/02; F04B 23/06
See application file for complete search history.

(56) References Cited

U.S. PATENT DOCUMENTS 4,761,118 A * 8/1988 Zanarini ..... F04B 9/1095 417/396
6,145,311 A * 11/2000 Cyphelly ..... F15B 11/0725 417/372
8,240,146 B1 * 8/2012 Bollinger ..... F01K 27/00 60/659

* cited by examiner

*Primary Examiner* — Abiy Teka
(74) *Attorney, Agent, or Firm* — Nathan V. Woodruff

(57) ABSTRACT

A power system has a piston pump that is driven by high pressure gas from a high pressure gas source that alternatingly pressurizes a first gas chamber and a second gas chamber to drive a first piston and a second piston such that the piston pump pressurizes hydraulic fluid from a hydraulic reservoir into a hydraulic accumulator. The expanded high pressure gas from the piston pump is expelled to a low pressure gas outlet and the pressurized hydraulic fluid is used as a motive fluid to perform work.

20 Claims, 5 Drawing Sheets

POWER SYSTEM

TECHNICAL FIELD

This relates to a power system that uses pneumatic and hydraulic pressures, and in particular, a power system that converts pneumatic pressure to generate hydraulic pressure.

BACKGROUND

On remote sites, such as a well site, it is often necessary to provide a power source to power various types of equipment, such as pumps, compressors, treatment equipment, separators, communications equipment, lighting, and the like. Common power sources include internal combustion engines used as a generator or a prime mover, photovoltaic panels, wind turbines, and the like.

SUMMARY

According to an aspect, there is provided a power system, comprising a piston pump comprising a first piston in a first cylinder connected to a second piston in a second cylinder, each of the first cylinder and the second cylinder having a gas chamber and a hydraulic chamber, wherein a volume of the gas chamber and a volume of the hydraulic chamber are variable, a source of high pressure gas connected by a switch to the gas chamber of the first cylinder and the gas chamber of the second cylinder, the switch being adapted to alternatingly supply high pressure gas to the first gas chamber and the second gas chamber to cause the first and second pistons to reciprocate, a low pressure gas outlet connected to alternatingly receive low pressure gas from the gas chamber of the second cylinder and the gas chamber of the first second cylinder, a hydraulic reservoir connected to supply low pressure hydraulic fluid to the hydraulic chamber of the first cylinder and the hydraulic chamber of the second cylinder, a hydraulic accumulator connected to receive high pressure hydraulic fluid from the hydraulic chamber of the second cylinder and the hydraulic chamber of the first cylinder, a work outlet that is connected to receive pressurized hydraulic fluid from the piston pump and the hydraulic accumulator, wherein the piston pump is configured such that: when the high pressure gas is supplied to the gas chamber of the first cylinder, the first and second pistons move such that low pressure gas is expelled from the gas chamber of the second cylinder, low pressure hydraulic fluid is supplied to the hydraulic chamber of the second cylinder, and high pressure hydraulic fluid in the hydraulic chamber of the first cylinder is expelled, and when the high pressure gas is supplied to the gas chamber of the second cylinder, the first and second pistons move such that low pressure gas is expelled from the gas chamber of the first cylinder, low pressure hydraulic fluid is supplied to the hydraulic chamber of the first cylinder, and high pressure hydraulic fluid in the hydraulic chamber of the second cylinder is expelled.

According to other aspects, the power system may comprise one or more of the following features, alone or in combination: the piston pump may be connected to the source of gas and the low pressure gas outlet by a switching valve; the switching valve may comprise a hydraulic shuttle valve that is actuated by a pilot valve in fluid communication with the hydraulic accumulator, the pilot valve comprising an actuator that is actuated by the movement of the first and second pistons; and the piston pump may be connected to the hydraulic reservoir and the hydraulic accumulator by check valves that permit low pressure hydraulic fluid to flow from the hydraulic reservoir to the hydraulic chambers of the first and second cylinders as the hydraulic chambers expand, and to flow from the hydraulic chambers of the first and second cylinders to the hydraulic accumulator as the hydraulic chambers retract.

According to an aspect, there is provided a power system, comprising a piston pump comprising a first cylinder comprising a first piston that defines a first gas chamber on a first side of the first piston and a first hydraulic chamber on a second side of the first piston, a second cylinder comprising a second piston that defines a second gas chamber on a second side of the second piston and a second hydraulic chamber on a first side of the second piston, a linkage that connects the first piston and the second piston such that the first and second pistons move together such that volumes of the first gas chamber, the second gas chamber, the first hydraulic chamber and the second hydraulic chamber vary as the first and second pistons reciprocate, a hydraulic fluid system comprising, a hydraulic reservoir connected to supply the piston pump with low pressure hydraulic fluid, a hydraulic accumulator connected to receive pressurized hydraulic fluid from the piston pump, a hydraulic fluid outlet that is connected to receive pressurized hydraulic fluid from the piston pump and the hydraulic accumulator, a gas pressure system comprising a high pressure gas inlet connected to supply the piston pump with high pressure gas, and a low pressure gas outlet connected to receive low pressure gas from the piston pump.

According to other aspects, the power system may comprise one or more of the following features, alone or in combination: the hydraulic fluid system may comprise check valves that permit the flow of the low pressure hydraulic fluid to the first and second hydraulic chambers and the flow of the pressurized hydraulic fluid from the first and second hydraulic chambers to the hydraulic accumulator; wherein the gas pressure system may comprise a switching valve that alternatingly connects the first and second gas chambers to the high pressure gas inlet and the low pressure gas outlet; the switching valve may comprise a hydraulic shuttle valve that is actuated by a pilot valve in fluid communication with the hydraulic accumulator, the pilot valve comprising an actuator that is actuated by the movement of the first and second pistons; and the piston pump may be connected to the hydraulic reservoir and the hydraulic accumulator by check valves that permit low pressure hydraulic fluid to flow from the hydraulic reservoir to the hydraulic chambers of the first and second cylinders as the hydraulic chambers expand, and to flow from the hydraulic chambers of the first and second cylinders to the hydraulic accumulator as the hydraulic chambers retract.

According to an aspect, there is provided a power system, comprising a piston pump comprising a first gas chamber, a second gas chamber, a first hydraulic chamber, and a second hydraulic chamber that are defined by a first piston and a second piston that is moveable with the first piston, the first gas chamber being opposite the second gas chamber and the first hydraulic chamber being opposite the second hydraulic chamber such that a volume of the first gas chamber and a volume of the first hydraulic chamber increase as a volume of the second gas chamber and a volume of the second hydraulic chamber decrease as the first piston and the second piston move in a first direction, a source of gas connected to alternatingly supply a high pressure gas to the first gas chamber and the second gas chamber to cause the first and second pistons to reciprocate, a low pressure gas outlet connected to alternatingly receive low pressure gas from the second gas chamber and the first gas chamber as the first and second pistons to reciprocate, a low hydraulic pressure side comprising a hydraulic reservoir connected to supply low pressure hydraulic fluid to the first hydraulic chamber and the second hydraulic chamber, a high hydraulic pressure side comprising a hydraulic accumulator connected to receive high pressure hydraulic fluid from the second hydraulic chamber and the first hydraulic chamber and a work outlet, wherein the piston pump is configured such that: when the high pressure gas is supplied to the first gas chamber, the first and second pistons move such that low pressure gas is expelled from the second gas chamber, low pressure hydraulic fluid is supplied to the second hydraulic chamber from the low hydraulic pressure side, and high pressure hydraulic fluid in the first hydraulic chamber is expelled to the high hydraulic pressure side, and when the high pressure gas is supplied to the second gas chamber, the first and second pistons move such that low pressure gas is expelled from the first gas chamber, low pressure hydraulic fluid is supplied to the first hydraulic chamber from the low hydraulic pressure side, and high pressure hydraulic fluid in the second hydraulic chamber is expelled to the high hydraulic pressure side.

According to other aspects, the power system may comprise one or more of the following features, alone or in combination: the piston pump may be connected to the source of gas and the low pressure gas outlet by a switching valve; the switching valve may comprise a hydraulic shuttle valve that is actuated by a pilot valve that controls a flow of hydraulic fluid from the high hydraulic pressure side, the pilot valve comprising an actuator that is actuated by the movement of the first and second pistons; the piston pump may be connected to the low hydraulic pressure side and the high hydraulic pressure side by check valves that permit low pressure hydraulic fluid to flow from the hydraulic reservoir to the first and second hydraulic chambers as the hydraulic chambers expand, and to flow from the first and second hydraulic chambers to the hydraulic accumulator as the first and second hydraulic chambers retract; the first piston, the first gas chamber, and the first hydraulic chamber comprise a first piston cylinder and the second piston, the second gas chamber, and the second hydraulic chamber comprise a second piston cylinder.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION OF PREFERRED EMBODIMENTS

Figure 1:
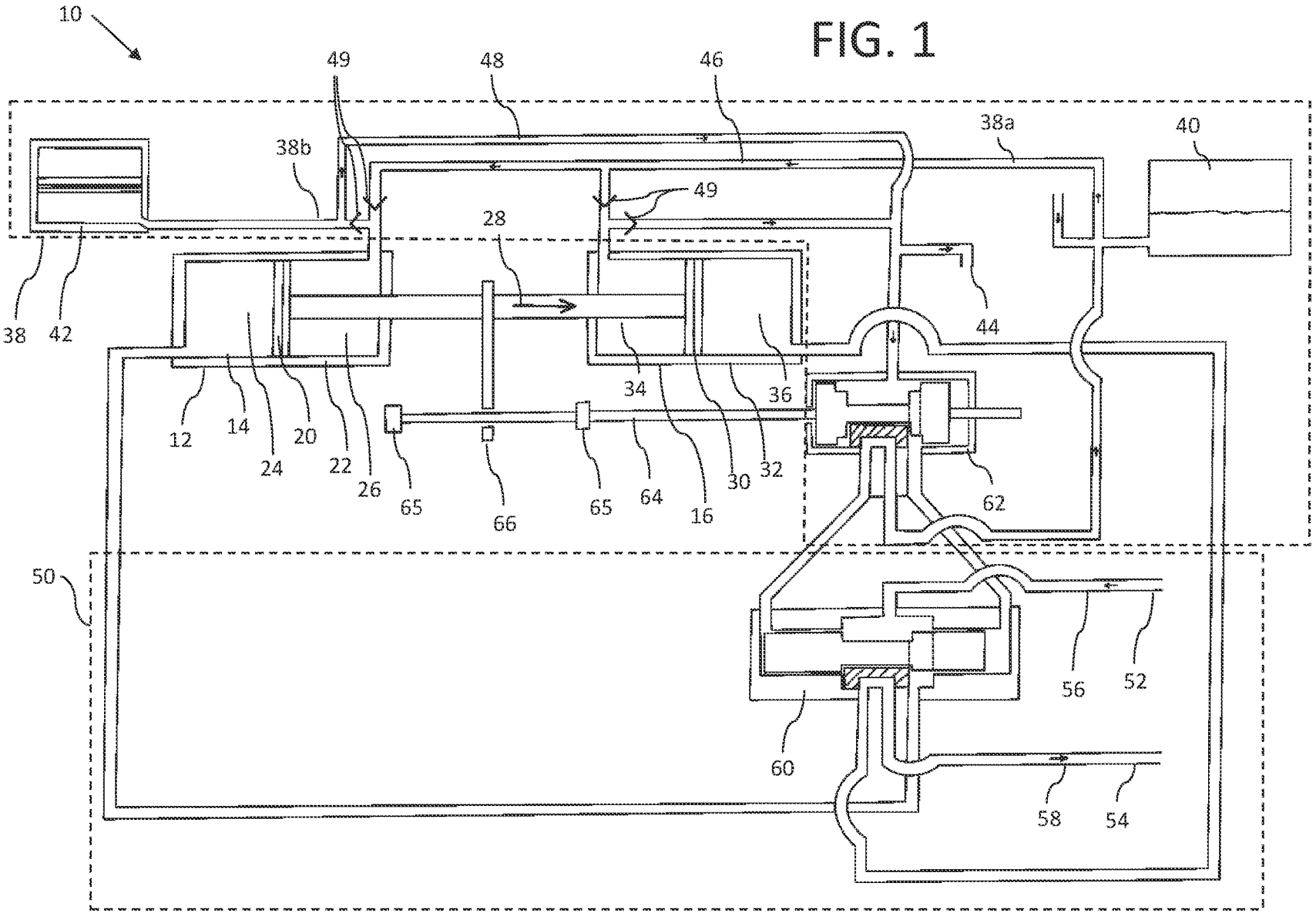
FIG. 1 is a schematic diagram of a power system with a shuttle valve in a first position.
Figure 2:
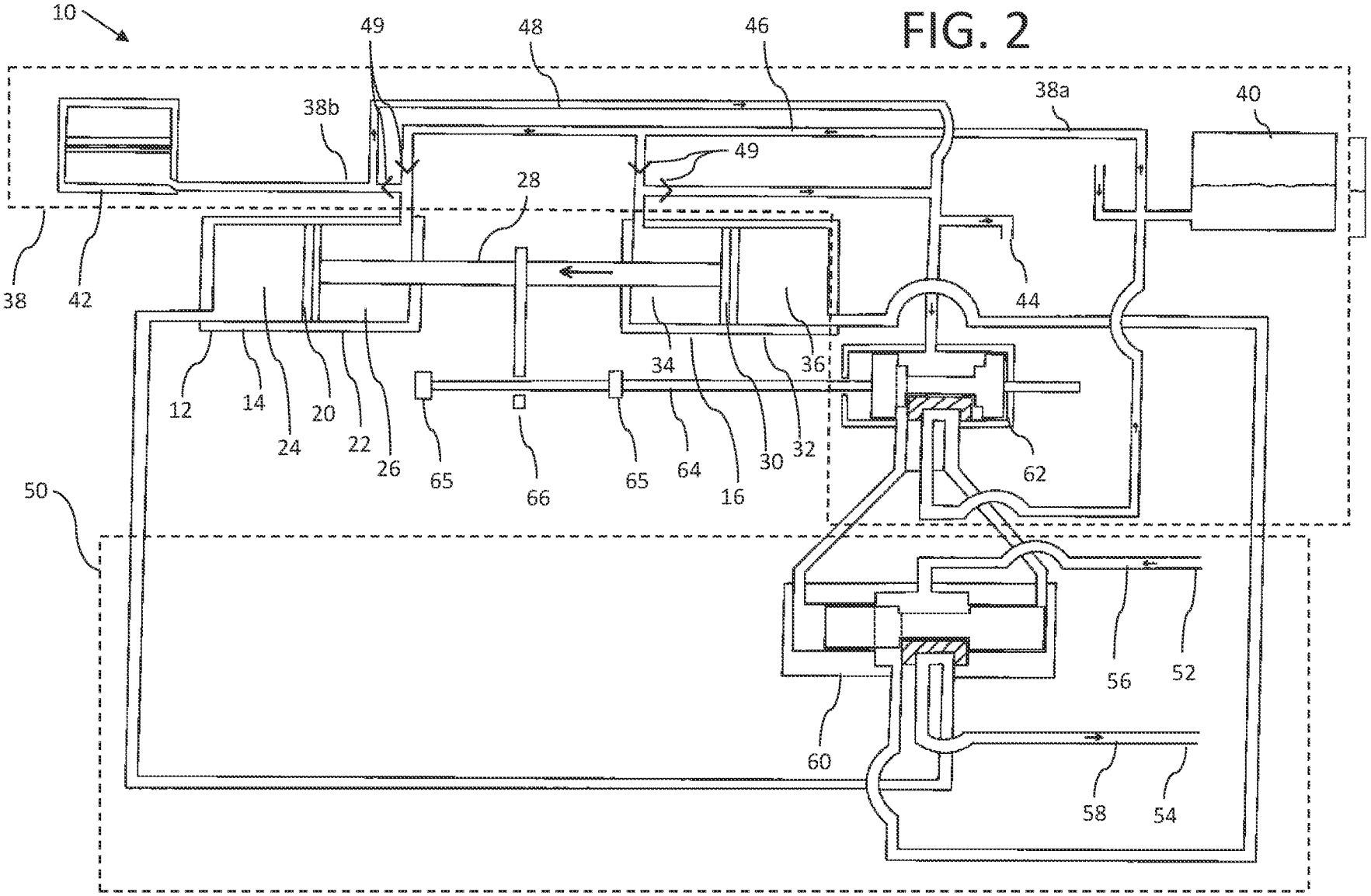
FIG. 2 is a schematic diagram of the power system of FIG. 1 with a shuttle valve in a second position.

A power system, generally identified by reference numeral 10, will now be described with reference to FIG. 1 through 5.

Referring to FIG. 1, power system 10 includes a piston pump 12 that has a first cylinder 14 and a second cylinder 16. First cylinder 14 has a first piston 20 enclosed within a first housing 22. First piston 20 separates the interior of first housing 22 into a first chamber 24 and a second chamber 26 on opposite sides of first piston 20. Second cylinder 16 has a second piston 30 enclosed within a second housing 32 that separates the interior of second housing 32 into a third chamber 34 and a fourth chamber 36 on opposite sides of second piston 30. First piston 20 and second piston 30 are connected by a linkage, such as a connecting rod 28 or other suitable linkage that causes first piston 20 and second piston 30 to reciprocate together. As first and second pistons 20 and 30 reciprocate, the volume of first and third chambers 24 and 34 increase or decrease while the volume of second and fourth chambers 26 and 36 decrease or increase. In the depicted design, first and fourth chambers 24 and 36 are gas chambers that receive a pressurized gas that drives first and second pistons 20 and 30, while second and third chambers 26 and 34 are hydraulic fluid chambers that receive and pressurize hydraulic fluid as first and second positions 20 and 30 reciprocate. The role of each chamber 24, 26, 34, 36 may vary depending on the preferences of the user and the design of piston pump 12. In the depicted example, with connecting rod 28 extending through hydraulic chambers 26 and 34, gas chambers 24 and 36 have a similar volume and hydraulic chambers 26 and 34 have a similar volume, such that the action of piston pump 12 is balanced as pistons 20 and 30 reciprocate within first and second cylinders 14 and 16, respectively.

Piston pump 12 is connected to a hydraulic fluid system 38 that includes a low pressure side 38*a* and a high pressure side 38*b*. Low pressure side 38*a* includes a hydraulic accumulator 42 and a work outlet 44. A low pressure fluid line 46 connects hydraulic reservoir 40 to second and third chambers 26 and 34 such that, as second and third chambers 26 and 34 expand, fluid is drawn from hydraulic reservoir 40 into the respective chamber 26 or 34. A high pressure fluid line 48 connects second and third chambers 26 and 34 to hydraulic accumulator 42 such that, as second and third chambers 26 and 34 contract, pressurized hydraulic fluid is communicated to hydraulic accumulator 42. Hydraulic accumulator 42 stores hydraulic energy and may be used to absorb pressure surges. Hydraulic accumulator 42 may be maintained at a desired pressure, which may determine the amount of work done by piston pump 12 based on the efficiency of piston pump 12, and the pressure differential between hydraulic reservoir 40, which may be at atmospheric pressure, and hydraulic accumulator 42. Hydraulic accumulator 42 may be any suitable type of accumulator, such as an accumulator with a variable volume that maintains a constant pressure, or substantially constant pressure, on the stored fluid. Check valves 49 may be used to ensure fluid flows in the desired directions as shown. Alternatively, a valve, such as a shuttle valve (not shown) may be used to alternatingly open and close fluid lines 46 and 48 to allow fluid flow in the desired manner. As noted, high pressure side 38*b* of hydraulic fluid system 38 includes a work outlet 44. Work outlet 44 may include a valve (not shown), either as part of hydraulic fluid system 38 or as part of the external equipment, that permits pressurized fluid to the external equipment and perform work. The pressurized fluid may flow from hydraulic accumulator 42 or directly from piston pump 12 as the case may be, depending on the amount and timing of the call for hydraulic fluid through work outlet 44.

As piston pump 12 is driven by gas pressure as described below to move in the direction shown in FIG. 1, hydraulic fluid is drawn into second chamber 26, while hydraulic fluid in third chamber 34 is pressurized and expelled. As piston pump 12 moves in the direction shown in FIG. 2, hydraulic fluid is drawn into third chamber 34, while hydraulic fluid in second chamber 26 is pressurized and expelled.

Piston pump 12 is connected to a gas pressure system 50 that includes a high pressure gas inlet 52 that is connected to supply first and fourth chambers 24 and 36 with high pressure gas, and a low pressure gas outlet 54 that is connected to exhaust low pressure gas from first and fourth chambers 24 and 36. As piston pump 12 is driven by gas pressure, first and fourth chambers 24 and 36 are alternatingly connected to either high pressure gas inlet 52 via gas line 56 or low pressure gas outlet 54 via gas line 58. A switching valve, such as a shuttle valve 60, or other switching mechanism, may be used to control the flow of gas to and from first and fourth chambers 24 and 36. With shuttle valve 60 in a first position shown in FIG. 1, high pressure gas inlet 52 is connected to supply high pressure gas to first chamber 24, and fourth chamber 36 is connected to vent low pressure gas via low pressure gas outlet 54. With shuttle valve 60 in a second position shown in FIG. 2, high pressure gas inlet 52 is connected to supply high pressure gas to fourth chamber 36, and first chamber 24 is connected to vent low pressure gas via low pressure gas outlet 54. In this manner, a source of high pressure gas may be used to drive piston pump 12 and release a lower pressure gas. It will be understood that "high" pressure and "low" pressure are relative terms, and in particular are relative to each other. The pressure differential between the high and low pressure gas streams relates to the amount of power generated by piston pump 12, and therefore the amount of hydraulic pressure that can be generated.

Figure 3:
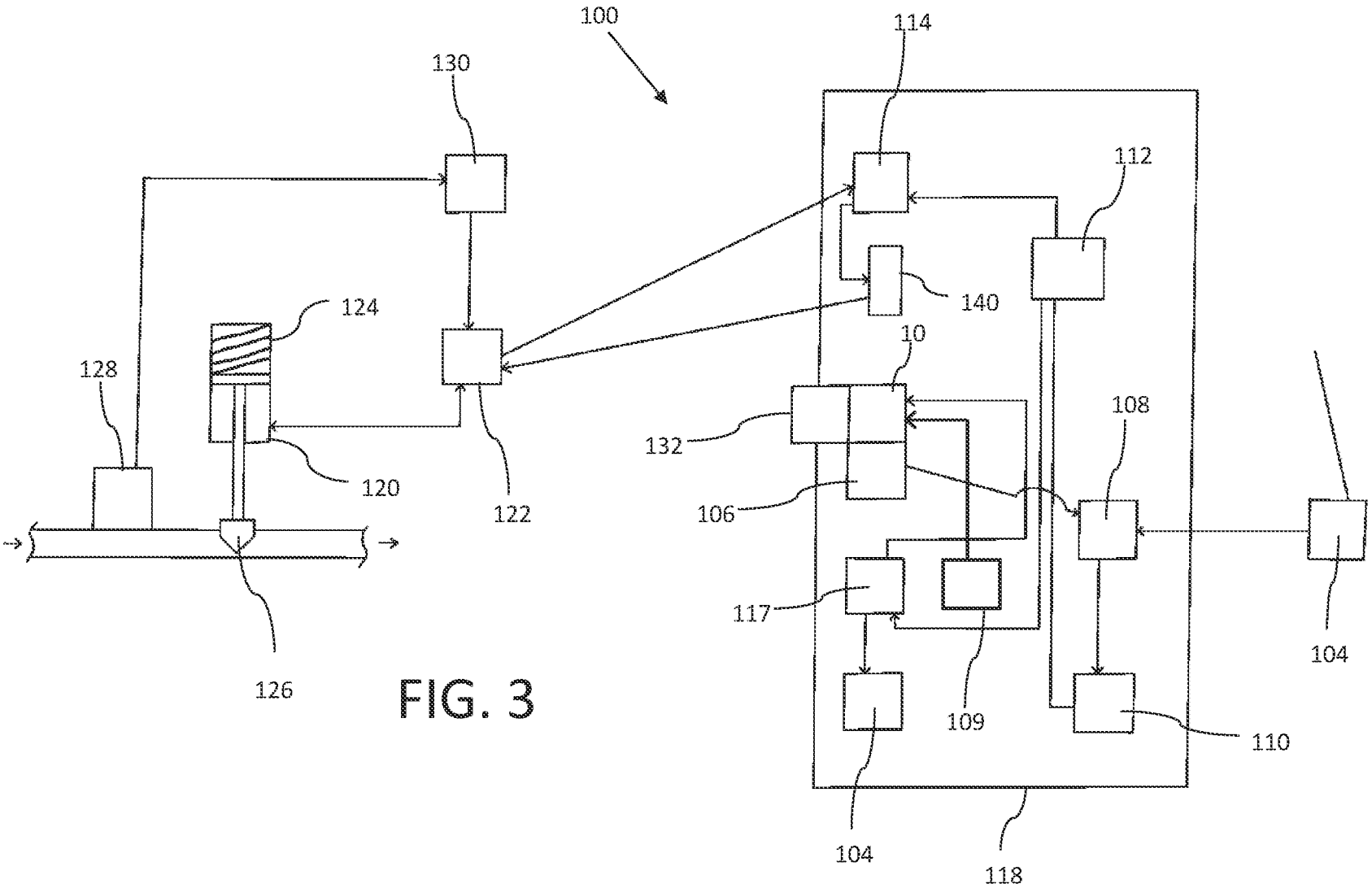
FIG. 3 is a schematic diagram of a power system integrated into a worksite in a first configuration.

High pressure gas inlet 52 may be connected to receive high pressure gas from a high pressure source of gas found on a well site, such as from a compressor (not shown), and low pressure gas outlet 54 may be connected to a gas pipeline, flare stack, gas storage tank, or the like, that is used to transport, dispose of, or store gas produced from a downhole well. As piston pump 12 uses positive displacement, it may also be used as a gas flow meter based on factors such as the cylinder displacement, the stroke rate, the temperature of the gas, the composition of the gas, and the pressure of the gas. This may be useful, for example, to measure the amount of gas that leaves a wellsite in order to calculate government royalties, company revenues, well performance, etc. Referring to FIG. 3, in order to calculate the gas flow rate, power system 10 may be connected to a processor that is programmed to calculate the gas flow rate based on some or all of the factors identified above and the number of cycles of piston pump 12.

As shown, shuttle valve 60 may be controlled by hydraulic fluid from high pressure side 38*b* of hydraulic system 38 via a hydraulically driven pilot valve 62. In the depicted example, pilot valve 62 is a slide valve that is controlled by a protruding control rod 64 that carries shoulders 65. Shoulders 65 are engaged by a linkage 66 carried by piston rod 28, such that, as piston pump 12 reciprocates, the movement causes shuttle valve 62 to switch. As pilot valve 62 switches, high pressure hydraulic fluid is supplied to alternating ends of shuttle valve 60, causing shuttle valve 60 to switch from the positions shown in FIGS. 1 and 2. In doing so, low pressure hydraulic fluid on the other end of shuttle valve 60 is expelled into low pressure side 38*a* of hydraulic system 38. Other switching mechanisms may also be used that are based on mechanical, hydraulic/pneumatic, electrical, or magnetic elements, such as electrically powered solenoid valves and proximity sensors with control logic. As shown, each of the seals in piston pump 12, shuttle valve 60, pilot valve 62, are in contact with hydraulic fluid, which may improve the longevity and reliability of the seals.

In the depicted example, high pressure gas in chamber 24 or 36 is released at the end of the stroke into low pressure gas line 58 as pilot valve 62 causes shuttle valve 60 to shift. As the high pressure gas in chamber 24 or 36 expands to a low pressure gas, the temperature will drop as a result of the Joule Thomson effect. The amount of temperature drop will depend on the pressure drop. If the temperature drop is sufficient, there may be a risk of freezing. At the same time, the expansion of chamber 24 or 36 will compress gas in the opposite gas chamber 36 or 24. As this opposite gas chamber 36 or 24 is closed until the end of the stroke is reached, the compression will cause the temperature to increase. This heating within chamber 24 and 36 during the compression portion of the stroke helps counter the effects of the expansion cooling and reduces the risk of freezing, and is permitted by providing opposed gas chambers, and maintaining the (initially) low pressure gas chamber closed until the end of the stroke is reached and it is opened to high pressure gas source 52 via gas line 56 based on the position of valve 60.

Referring now to FIG. 3, an example of a power system 10 for a remote site 100, such as a wellsite, is shown. Remote site 100 may also include other power sources, such as solar panels 104, which may be used as a primary electrical power source, and a backup generator 106. A charge controller 108 may be used to maintain the storage level in an electrical storage device, such as a battery bank 110. Charge controller 108 may perform other functions. For example, in the event of a low battery storage level and low solar out-put, charge controller 108 may be programmed to signal backup generator 106 to start and supply electric power to charge battery bank 110. It will be understood that the various controllers and processors described herein may be combined into one or more general purpose processing units, or may be separate, purpose-built controllers.

Battery bank 110 may be connected to supply direct current electric power to an inverter 112, which converts direct current power to alternating current power to supply electrical power requirements on site, such as an electric power pack 114, an electric heater 116 via a temperature controller 117, or other power requirements. A cabinet 118 may be used to store some or all of the equipment described above and may be used to support solar panels 104 where appropriate. Cabinet 118 may be insulated to protect the equipment against temperature extremes.

In some cases, a backup hydraulic pump 140 may be powered by battery bank 110 to keep hydraulic accumulator 42 (shown in FIGS. 1 and 2) charged with hydraulic pressure or to provide hydraulic pressure directly. Work outlet 44 may be connected to supply hydraulic energy to hydraulically powered equipment, such as a hydraulic actuator 120 via a valve actuator controller 122. Hydraulic actuator 120 may be used to cause the fail-safe 124 to keep the flow control valve 126 open. If fail-safe 124 is a spring as shown, the pressure of the hydraulic fluid is be sufficient to overcome the spring force of fail-safe 124. When the hydraulic oil pressure is released from hydraulic actuator 120 via valve actuator controller 122, a fail safe 124 may allow or cause flow control valve 126 to close. As shown, fail safe 124 is a valve close spring in hydraulic actuator 120.

A flow indicator 128 may be used to send flow information to a flow controller 130, which in turn sends a signal to valve actuator controller 122, which may be programmed to send a metered amount of pressurized oil to hydraulic actuator 120 to maintain a desired flow rate, or a flow rate within a predetermined range.

Figure 5:
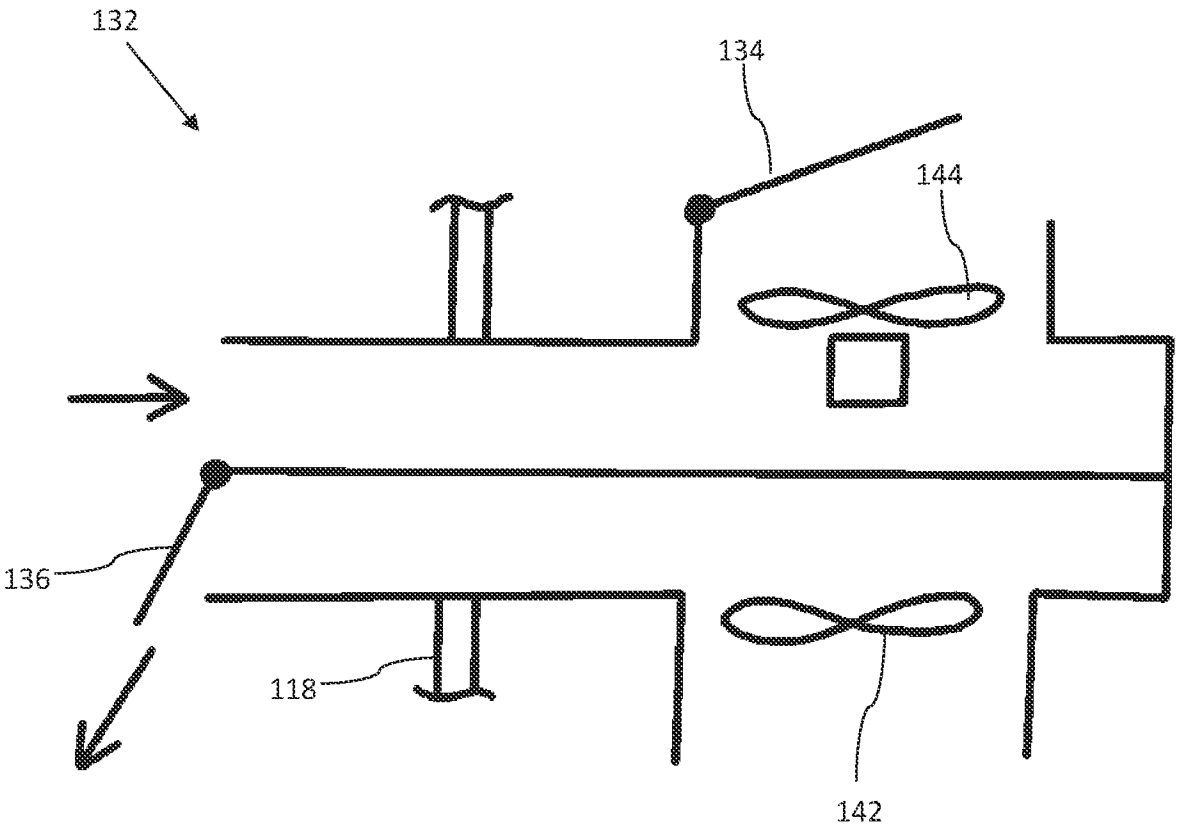
FIG. 5 is an elevated side view in cross section of a heat exchanger.

Cabinet 118 may include a heat exchanger 132 that preheats incoming air. Referring to FIG. 5, heat exchanger 132 may have inlet and outlet louvers 134 and 136 that selectively allow air exchange from cabinet 118 when an engine cooling fan 142 or the master temperature control fan 144 are in operation. Engine cooling fan 142 may be used to remove hot engine cooling air from cabinet 118, while master temp control fan 144 may be used to provide additional cooling to supplement engine cooling fan 144, or to lower the temperature within cabinet 118 when the temperature within cabinet 118 is otherwise too hot, such as due to hot ambient temperatures, heat generated by other equipment within cabinet 118, etc.

Figure 4:
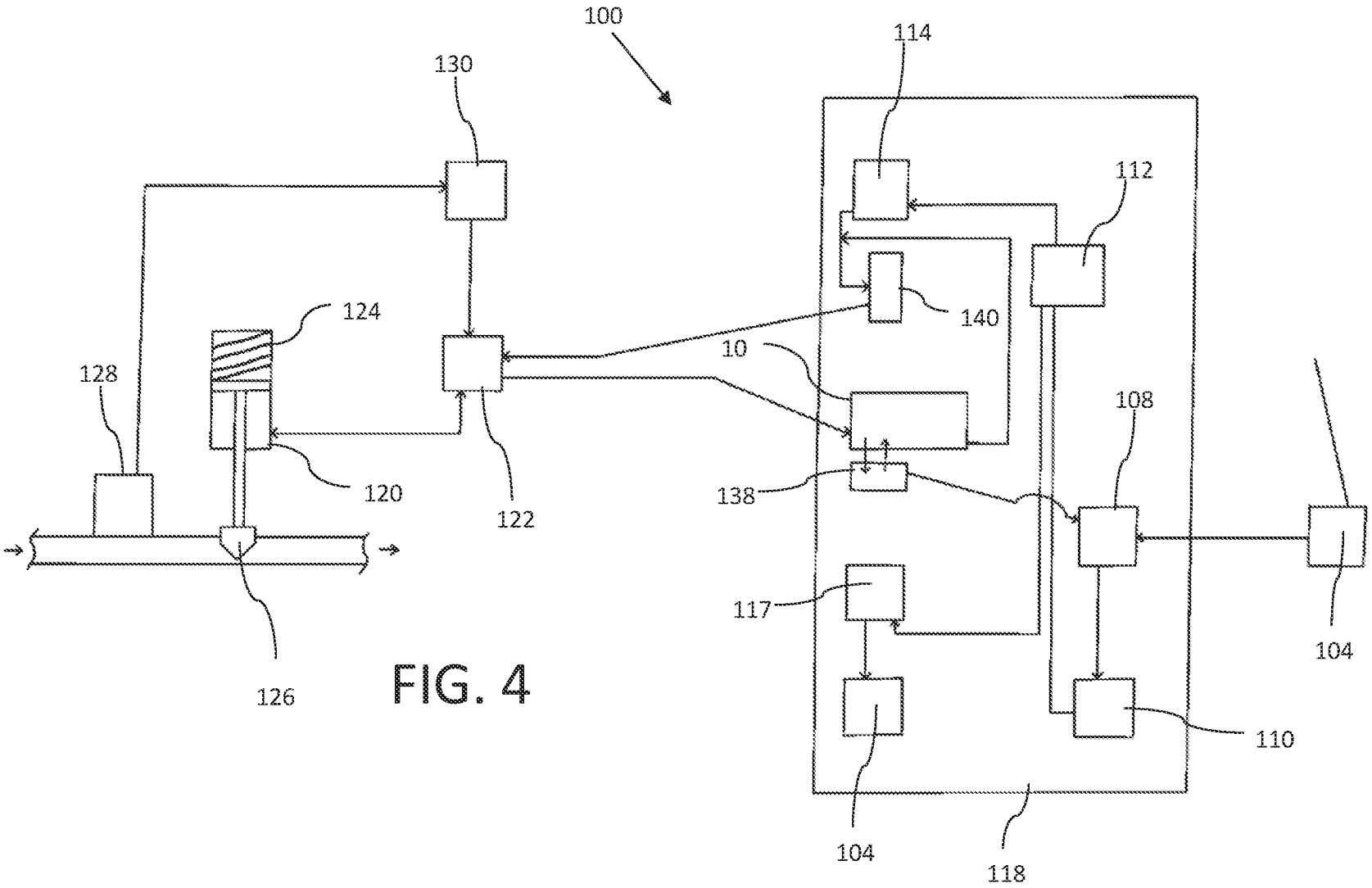
FIG. 4 is a schematic diagram of a power system integrated into a worksite in a second configuration.

In another example, referring to FIG. 4, hydraulic power from power system 10 described above may be used as the power source on a well site, such as by powering hydraulically-driven components, directly, or by generating electricity via a hydraulically-driven generator 138. In the system described above, power system 10 may be used in place of or in parallel with backup generator 106, depending on the power and redundancy requirements of a given implementation. Solar panels 104 may be used as an electrical power source to charge battery bank 110, either as the primary source or as a secondary source of electricity. Solar panels 104 may charge battery bank 110 as described above, and hydraulically-driven generator 138 may be triggered when more electrical power is required, such as where the demand is higher than usual or during low solar output. Solar panels 104 and battery bank 110 may also be used to power a hydraulic pump 140 if power system 10 is unable to supply sufficient hydraulic power.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A power system, comprising:

a piston pump comprising a first piston in a first cylinder connected to a second piston in a second cylinder, each of the first cylinder and the second cylinder having a gas chamber and a hydraulic chamber, wherein a volume of the gas chamber and a volume of the hydraulic chamber are variable;

a source of high pressure gas connected by a switching valve to the gas chamber of the first cylinder and the gas chamber of the second cylinder, the switching valve being adapted to alternatingly supply high pressure gas to the gas chamber of the first cylinder and the gas chamber of the second cylinder to cause the first and second pistons to reciprocate;

a low pressure gas outlet connected by the switching valve to alternatingly receive low pressure gas from the gas chamber of the second cylinder and the gas chamber of the first cylinder;

a hydraulic reservoir connected to supply low pressure hydraulic fluid to the hydraulic chamber of the first cylinder and the hydraulic chamber of the second cylinder; and a work outlet that is connected to receive pressurized hydraulic fluid generated by the piston pump;

wherein the piston pump is configured such that:

when the high pressure gas is supplied to the gas chamber of the first cylinder, the first and second pistons move such that low pressure gas is expelled from the gas chamber of the second cylinder, low pressure hydraulic fluid is supplied to the hydraulic chamber of the second cylinder, and high pressure hydraulic fluid in the hydraulic chamber of the first cylinder is expelled; and when the high pressure gas is supplied to the gas chamber of the second cylinder, the first and second pistons move such that low pressure gas is expelled from the gas chamber of the first cylinder, low pressure hydraulic fluid is supplied to the hydraulic chamber of the first cylinder, and high pressure hydraulic fluid in the hydraulic chamber of the second cylinder is expelled.

2. The power system of claim 1, further comprising a hydraulic accumulator connected to receive high pressure hydraulic fluid from the hydraulic chamber of the second cylinder and the hydraulic chamber of the first cylinder and wherein the switching valve comprises a hydraulic shuttle valve that is actuated by a pilot valve in fluid communication with the hydraulic accumulator, the pilot valve comprising an actuator that is actuated by movement of the first and second pistons.

3. The power system of claim 1, further comprising a hydraulic accumulator connected to receive high pressure hydraulic fluid from the hydraulic chamber of the second cylinder and the hydraulic chamber of the first cylinder, and wherein the piston pump is connected to the hydraulic reservoir and the hydraulic accumulator by check valves that permit low pressure hydraulic fluid to flow from the hydraulic reservoir to the hydraulic chambers of the first and second cylinders as the hydraulic chambers expand, and to flow from the hydraulic chambers of the first and second cylinders to the hydraulic accumulator as the hydraulic chambers retract.

4. The power system of claim 1, wherein the piston pump is cooled as gas expands in the gas chambers, and warmed as gas is compressed in the gas chambers.

5. The power system of claim 1, further comprising a processor comprising instructions to calculate a gas flow rate based on a detected number of cycles of the piston pump.

6. The power system of claim 1, wherein the first piston is connected to the second piston by a mechanical linkage.

7. A power system, comprising:

a piston pump comprising:

a first cylinder comprising a first piston that defines a first gas chamber on a first side of the first piston and a first hydraulic chamber on a second side of the first piston;

a second cylinder comprising a second piston that defines a second gas chamber on a second side of the second piston and a second hydraulic chamber on a first side of the second piston; and a linkage that connects the first piston and the second piston such that the first and second pistons move together such that volumes of the first gas chamber, the second gas chamber, the first hydraulic chamber and the second hydraulic chamber vary as the first and second pistons reciprocate;

a hydraulic fluid system comprising:

a hydraulic reservoir connected to supply the piston pump with low pressure hydraulic fluid;

a hydraulic accumulator connected to receive pressurized hydraulic fluid from the piston pump;

a hydraulic fluid outlet that is connected to receive pressurized hydraulic fluid from the piston pump and the hydraulic accumulator; and a plurality of check valves connected:

between the hydraulic reservoir and the first hydraulic chamber and the second hydraulic chamber that permit the flow of the low pressure hydraulic fluid to the first and second hydraulic chambers, and between the first hydraulic chamber and the second hydraulic chamber that permit the flow of the pressurized hydraulic fluid to the hydraulic accumulator; and a gas pressure system comprising:

a high pressure gas inlet connected to supply the piston pump with high pressure gas; and a low pressure gas outlet connected to receive low pressure gas from the piston pump.

8. The power system of claim 7, wherein the gas pressure system comprises a switching valve that alternatingly connects the first and second gas chambers to the high pressure gas inlet and the low pressure gas outlet.

9. The power system of claim 8, wherein the switching valve comprises a hydraulic shuttle valve that is actuated by a pilot valve in fluid communication with the hydraulic accumulator, the pilot valve comprising an actuator that is actuated by the movement of the first and second pistons.

10. The power system of claim 7, wherein the piston pump is connected to the hydraulic reservoir and the hydraulic accumulator by check valves that permit low pressure hydraulic fluid to flow from the hydraulic reservoir to the hydraulic chambers of the first and second cylinders as the hydraulic chambers expand, and to flow from the hydraulic chambers of the first and second cylinders to the hydraulic accumulator as the hydraulic chambers retract.

11. The power system of claim 7, wherein the piston pump is cooled as gas expands in the first gas chamber and the second gas chamber, and is warmed as gas is compressed in the first gas chamber and the second gas chamber.

12. The power system of claim 7, further comprising a processor comprising instructions to calculate a gas flow rate based on a number of cycles of the piston pump.

13. The power system of claim 7, wherein the linkage is a connecting rod.

14. A power system, comprising:

a piston pump comprising a first gas chamber, a second gas chamber, a first hydraulic chamber, and a second hydraulic chamber that are defined by a first piston and a second piston that is moveable with the first piston, the first gas chamber being opposite the second gas chamber and the first hydraulic chamber being opposite the second hydraulic chamber such that a volume of the first gas chamber and a volume of the first hydraulic chamber increase as a volume of the second gas chamber and a volume of the second hydraulic chamber decrease as the first piston and the second piston move in a first direction;

a source of gas connected to alternatingly supply a high pressure gas to the first gas chamber and the second gas chamber to cause the first and second pistons to reciprocate;

a low pressure gas outlet connected to alternatingly receive low pressure gas from the second gas chamber and the first gas chamber as the first and second pistons to reciprocate;

a switching valve that connects the piston pump to the source of gas and the low pressure gas outlet;

a low hydraulic pressure side comprising a hydraulic reservoir connected to supply low pressure hydraulic fluid to the first hydraulic chamber and the second hydraulic chamber; and a high hydraulic pressure side comprising a hydraulic accumulator connected to receive high pressure hydraulic fluid from the second hydraulic chamber and the first hydraulic chamber and a work outlet;

wherein the piston pump is configured such that:

when the high pressure gas is supplied to the first gas chamber, the first and second pistons move such that low pressure gas is expelled from the second gas chamber, low pressure hydraulic fluid is supplied to the second hydraulic chamber from the low hydraulic pressure side, and high pressure hydraulic fluid in the first hydraulic chamber is expelled to the high hydraulic pressure side; and when the high pressure gas is supplied to the second gas chamber, the first and second pistons move such that low pressure gas is expelled from the first gas chamber, low pressure hydraulic fluid is supplied to the first hydraulic chamber from the low hydraulic pressure side, and high pressure hydraulic fluid in the second hydraulic chamber is expelled to the high hydraulic pressure side.

15. The power system of claim 14, wherein the switching valve comprises a hydraulic shuttle valve that is actuated by a pilot valve that controls a flow of hydraulic fluid from the high hydraulic pressure side, the pilot valve comprising an actuator that is actuated by the movement of the first and second pistons.

16. The power system of claim 14, wherein the piston pump is connected to the low hydraulic pressure side and the high hydraulic pressure side by check valves that permit low pressure hydraulic fluid to flow from the hydraulic reservoir to the first and second hydraulic chambers as the hydraulic chambers expand, and to flow from the first and second hydraulic chambers to the hydraulic accumulator as the first hydraulic chamber and the second hydraulic chamber reciprocate.

17. The power system of claim 14, wherein the first piston, the first gas chamber, and the first hydraulic chamber comprise a first piston cylinder and the second piston, the second gas chamber, and the second hydraulic chamber comprise a second piston cylinder.

18. The power system of claim 14, wherein the piston pump is cooled as gas expands in the first gas chamber and the second gas chamber, and is warmed as gas is compressed in the first gas chamber and the second gas chamber.

19. The power system of claim 14, further comprising a processor comprising instructions to calculate a gas flow rate based on a number of cycles of the piston pump.

20. The power system of claim 14, wherein the first piston is connected to the second piston by a mechanical linkage.

* * * * *